US005921856A

United States Patent [19]

Zimmer

[11] Patent Number: 5,921,856

[45] Date of Patent: Jul. 13, 1999

[54] CVD DIAMOND COATED SUBSTRATE FOR POLISHING PAD CONDITIONING HEAD AND METHOD FOR MAKING SAME

[75] Inventor: Jerry W. Zimmer, Saratoga, Calif.

[73] Assignee: sp3, Inc., Mountain View, Calif.

[21] Appl. No.: 09/094,930

[22] Filed: Jun. 15, 1998

Related U.S. Application Data

[60] Provisional application No. 60/052,145, Jul. 10, 1997.

[51] Int. Cl.[6] ..... B24D 11/00

[52] U.S. Cl. ..... 451/539; 451/526

[58] Field of Search ..... 51/294, 295; 451/526, 451/529, 534, 539, 533, 528, 532

[56] References Cited

U.S. PATENT DOCUMENTS

| | | | |
|---|---|---|---|
| 2,201,195 | 5/1940 | Melton et al. | 451/539 |
| 2,277,520 | 3/1942 | Martin et al. | 451/539 |
| 3,334,041 | 8/1967 | Dyer et al. | 451/539 |
| 4,486,200 | 12/1984 | Heyer et al. | 51/295 |
| 4,576,612 | 3/1986 | Shukla et al. | 451/526 |
| 4,606,154 | 8/1986 | Herrmann et al. | 451/526 |
| 4,991,362 | 2/1991 | Heyer et al. | 51/400 |
| 4,992,082 | 2/1991 | Drawl et al. | 51/295 |
| 5,186,973 | 2/1993 | Garg et al. | 427/590 |
| 5,318,836 | 6/1994 | Ito et al. | 428/323 |
| 5,376,444 | 12/1994 | Grotepass et al. | 428/336 |
| 5,435,815 | 7/1995 | Ikegaya et al. | 51/295 |
| 5,454,750 | 10/1995 | Cosmano et al. | 451/526 |
| 5,536,202 | 7/1996 | Appel et al. . | |
| 5,543,210 | 8/1996 | Kullander et al. | 428/217 |
| 5,551,959 | 9/1996 | Martin et al. | 51/295 |
| 5,643,669 | 7/1997 | Tsuei | 428/354 |
| 5,707,409 | 1/1998 | Martin et al. | 51/295 |

*Primary Examiner*—David A. Scherbel
*Assistant Examiner*—Derris Holt Bank
*Attorney, Agent, or Firm*—Coudert Brothers

[57] ABSTRACT

A flat substrate polishing pad conditioning head for a chemical-mechanical-planarization apparatus is provided which has been shown to double the useable life of a polishing pad used to planarize and/or polish both oxide and metal outer layers in the processing of semiconductor wafers and to provide for more uniform polishing during the life of the polishing pad. The polishing pad conditioning head (24) comprises a suitable substrate (26), a diamond grit (28) that is evenly distributed over the surface of the substrate (26) and a CVD diamond (30) grown onto the diamond grit (28) and the substrate (26) so that the diamond grit (28) becomes encased in the CVD diamond (30) and bonded to the surface of the substrate (26).

35 Claims, 6 Drawing Sheets

CVD DIAMOND COATED SUBSTRATE FOR POLISHING PAD CONDITIONING HEAD AND METHOD FOR MAKING SAME

This application claims the benefit of prior U.S. provisional application Ser. No. 60/052,145, filed Jul. 10, 1997.

FIELD OF THE INVENTION

The present invention relates to flat substrate polishing and Chemical-Mechanical-Planarization (CMP) polishing pad conditioning heads or disks. This invention is capable of conditioning polishing pads used to planarize and/or polish both dielectric and semiconductor (oxide) films and metal films on semiconductor wafers as well as wafers and disks used in computer hard disk drives. This invention also relates to continuous CVD diamond coated substrates having sufficient surface roughness for use in other abrasive sanding, grinding or polishing tools.

BACKGROUND OF THE INVENTION

CMP represents a major portion of the production cost for semiconductor wafers. These CMP costs include polishing pads, polishing slurry, pad conditioning disks and a variety of CMP parts that become worn during the planarizing and polishing operations. The total cost for the polishing pad, the downtime to replace the pad and the cost of the test wafers to recalibrate the pad is approximately $7 for a single wafer polishing run. In many complex integrated circuit devices, up to five CMP runs are required for each finished wafer which further increase the total manufacturing costs for such wafers.

The greatest amount of wear on the polishing pads is the result of polishing pad conditioning that is necessary to place the pad into a suitable condition for these wafer planarization and polishing operations. A typical polishing pad comprises a closed-cell polyurethane foam approximately 1/16 inch thick. During pad conditioning, the pads are subjected to mechanical abrasion to physically cut through the cellular layers of the surface of the pad. The exposed surface of the pad contains open cells which trap an abrasive slurry consisting of the spent polishing slurry and material removed from the wafer. In each subsequent pad conditioning step, the ideal conditioning head removes only the outer layer of cells containing the embedded materials without removing any of the layers below the outer layer. Such an ideal conditioning head would achieve a 100% removal rate with the lowest possible removal of layers on the polishing pad, i.e., lowest possible pad wear rate. It is apparent that a 100% removal rate can be achieved if there were no concern for its adverse affect of wear on the pad. However, such over-texturing of the pad results in a shortening of the pad life. On the other hand, under-texturing results in insufficient material removal rate during the CMP step and lack of wafer uniformity. Using the prior art conditioning heads that achieve satisfactory removal rates, as low as 200 to 300 and as high as several thousand wafer polishing runs, depending on the specific run conditions, can be made before the pad becomes ineffective and must be replaced. This occurs after the pad is reduced approximately to half of its original thickness.

There is a great need for a conditioning head that achieves as close to the ideal balance between high wafer removal rates and low pad wear rate so that the polishing pad effective life can be significantly increased without sacrificing the quality of the conditioning.

The prior art conditioning heads typically comprise a stainless steel plate, a non-uniform distribution of diamond grit over the surface of the plate and a wet chemical plated over-coat of nickel to cover the plate and the grit. The use of such prior art conditioning heads is limited to the conditioning of polishing pads which have been used during oxide CMP wafer processing, i.e. when the exposed outer layer is an oxide-containing material as opposed to metal. In processing a semiconductor wafer, there are about the same number of oxide and metal CMP processing steps. However, the prior art heads are ineffective for conditioning metal processing operations. This is the case because the slurry used to remove metal from the wafer reacts with the nickel and degrades and otherwise dissolves the nickel outer layer of the conditioning head and causes a major loss of the diamond grit from the plate, potentially scratching the wafers.

There is a great need for a head that is effective in conditioning both oxide-containing and metal-containing wafer surfaces. There is also a great need for a conditioning head in which the diamond grit is more firmly attached to the underlying substrate. There is also a need for a conditioning head that provides a greater degree of uniformity of wafer material being removed from a given wafer during the CMP operation. Finally, there is a need for a conditioning head that extends the life of the polishing pads.

SUMMARY OF THE INVENTION

The present invention is directed to a polishing pad conditioning head for a CMP and similar types of apparatus that has been found to double the life of the polishing pad without sacrificing wafer removal rates and methods for making the polishing pads. In addition, the conditioning head of the present invention:

(1) is effective in conditioning polishing pads used to process metal as well as oxide surfaces;

(2) is manufactured so that the diamond grit is more firmly attached to the substrate and consequently does not detach from the substrate to potentially scratch the wafer; and (3) provides a greater degree of uniformity of material removed across a given wafer.

In a CMP and similar apparatus, a polishing pad conditioning head is provided which comprises a substrate, a mono-layer of diamond grit substantially uniformly distributed on the substrate, and an outer layer of chemical vapor deposited (CVD) diamond grown onto the resulting grit covered substrate to encase and bond said polycrystalline diamond grit to said surface.

By the term of "chemically vapor deposited", it is intended to mean materials deposited by vacuum deposition processes, including thermally-activated deposition from reactive gaseous precursor materials; and plasma, microwave, and DC or RF plasma arc-jet deposition from gaseous precursor materials.

DESCRIPTION OF THE PREFERRED EMBODIMENTS OF THE INVENTION

Figure 1:
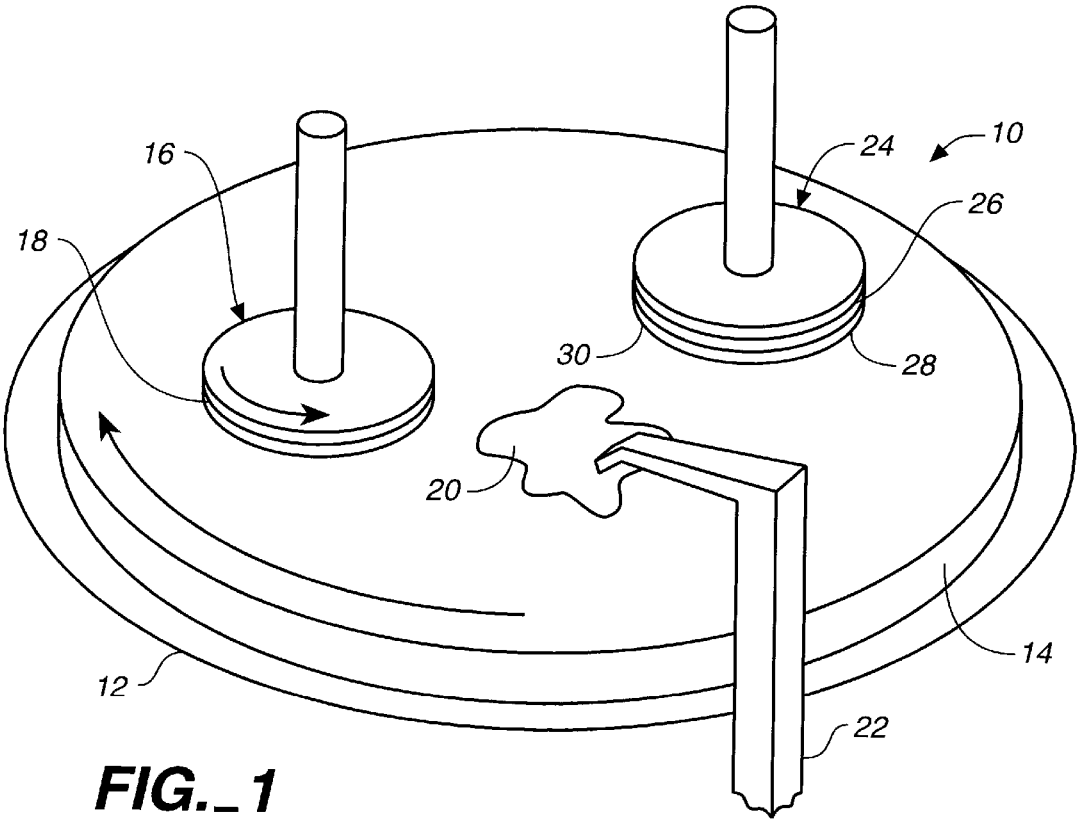
FIG. 1 illustrates a CMP apparatus in accordance with the present invention.

CMP apparatus 10 illustrated in FIG. 1 contains platen 12 with polishing pad 14 securely fastened thereto. Polishing pad 14 is shown rotating, for example, in a clockwise direction. Semiconductor wafer holder 16 with wafer 18 is positioned as shown to urge and maintain wafer 18 against the exposed surface of pad 14. Holder 16 is shown rotating, for example, in a counterclockwise direction. Wafer 18 is secured to holder 16 by means of a vacuum or other means well known in the art. Polishing slurry 20 is dispensed within the center region of pad 14 through the nozzle of conduit 22. Slurry 20 typically consists of silicon dioxide dispersed within a suitable liquid such as potassium hydroxide diluted with water. The exact composition of the slurry is closely calculated to provide the desired planarization of the exposed surface of the wafer. Although apparatus 10 shows only one wafer holder, CMP equipment is commercially available that includes multiple holders.

Polishing pad conditioning head or disk 24 comprises substrate 26, natural or synthetic diamond grit 28 evenly distributed over the surface of substrate 26 and a continuous thin film 30 of CVD polycrystalline diamond (hereinafter referred to as "CVD diamond") grown onto grit 28 and substrate 26 so that grit 28 is encased in CVD diamond 30 and bonded to the surface of substrate 26.

A uniform layer 30 of CVD diamond is grown onto the exposed surface of substrate 26 using a hot filament CVD (HFCVD) reactor of the type described and claimed in Garg, et al., U.S. Pat. No. 5,186,973, issued Feb. 16, 1993; the portions relevant to growing CVD diamond onto substrates are incorporated by reference herein.

Preferably, the CVD diamond is chemically vapor deposited onto the surface of the substrate such that the CVD diamond layer exhibits enhanced crystal orientation in either the (220) or the (311) direction and the (400) direction over that of industrial grade of diamonds. The phrase "chemically vapor deposited" is intended to mean the deposition of a layer of CVD diamond resulting from the decomposition of a feed gas mixture of hydrogen and carbon compounds, preferably hydrocarbons, into diamond generating carbon atoms from a gas phase activated in such a way as to avoid substantially graphitic carbon deposition. The preferred types of hydrocarbons include $C_1$–$C_4$ saturated hydrocarbons such as methane, ethane, propane and butane; $C_1$–$C_4$ unsaturated hydrocarbons, such as acetylene, ethylene, propylene and butylene, gases containing C and O such as carbon monoxide and carbon dioxide, aromatic compounds such as benzene, toluene, xylene, and the like; and organic compounds containing C, H, and at least one oxygen and/or nitrogen such as methanol, ethanol, propanol, dimethyl ether, diethyl ether, methyl amine, ethyl amine, acetone, and similar compounds. The concentration of carbon compounds in the hydrogen gas can vary from about 0.01% to about 10%, preferably from about 0.2 to about 5%, and more preferably from about 0.5 to about 2%. The resulting diamond film in the HFCVD deposition method is in the form of adherent individual crystallites or a layer-like agglomerates of crystallines substantially free from intercrystalline adhesion binder.

The total thickness of the CVD diamond is at least about 10% of the grit size. Preferably, the total thickness of the diamond film is about 10 to 250 microns. Still more preferably, it is about 20 to 30 microns.

The HFCVD process involves activating a feed gaseous mixture containing a mixture of a hydrocarbon and hydrogen by heated filament and flowing the activated gaseous mixture over a heated substrate to deposit the polycrystalline diamond film. The feed gas mixture, containing from 0.1 to about 10% hydrocarbon in hydrogen, is thermally activated under sub-atmosphere pressure, i.e. no greater than 100 Torr, to produce hydrocarbon radicals and atomic hydrogen by using a heated filament made of W, Ta, Mo, Re or a mixture thereof. The filament ranges from about 1800° to 2800° C. The substrate is heated to a deposition temperature of about 600° to about 1100° C.

The surface roughness resulting from simply growing CVD diamond on a silicon substrate ranges from about 6 to 12 microns from peak-to-valley on a substrate having a thickness of 25 microns of CVD diamond. In general, the surface roughness for a typical operation ranges from about ¼ to about ½ the thickness of the CVD diamond that is grown on the substrate. This degree of surface roughness is too low to provide the desired abrasive efficiency for CMP conditioning operations. In the present invention, diamond grit, commercially available from the cutting of natural diamonds and from industrial grade diamonds using high pressure processes, is incorporated into the structure of the thin CVD film. The size of the grit is chosen so that the peak-to-valley surface distance is greater than the thickness of the CVD diamond film. The diamond grit is uniformly distributed over the surface of the substrate at a density such that the individual grains are separated by no less than ½ the average grain diameter. The average size of the diamond grit is in the range of about 15 microns to about 150 microns, preferably in the range of about 35 microns to about 70 microns. By controlling the size and density of the diamond grit, the abrasive characteristics of the resulting surface can be adjusted for various conditioning applications. The grain size on a given disk will be equal in size to approximately ±20%.

Figure 2:
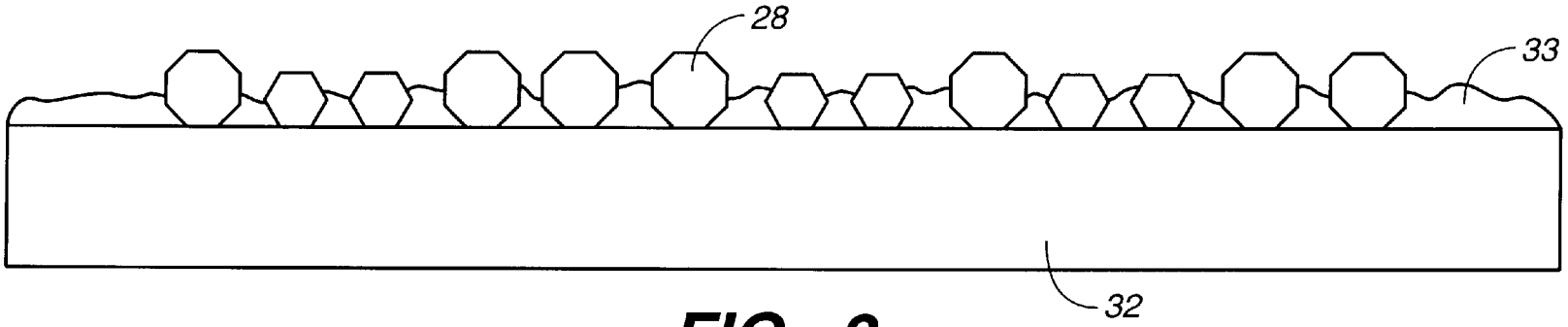
FIG. 2 (PRIOR ART)
FIG. 2 illustrates a diagrammatic cross-sectional view of a polishing pad conditioning head in accordance with the prior art.

FIG. 2 shows a cross-section of a prior art conditioning head in which a non-uniform layer of diamond grit 28 is distributed on the surface of backing plate 32, such as stainless steel plate, and nickel plating 33 is deposited by a wet chemical process to insecurely bond the diamond grit 28 to backing plate 32.

Figure 3:
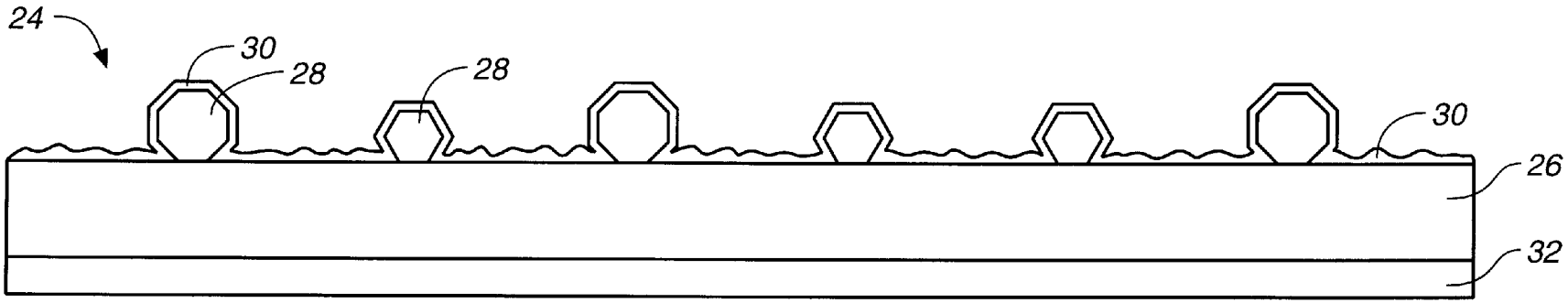
FIG. 3 illustrates a diagrammatic cross-sectional view of a polishing pad conditioning head in accordance with one embodiment of the present invention.

FIG. 3 shows a cross-section of conditioning disk 34 that is of substantially the same composition as conditioning head 24 described above except for the optional backing plate 32. Substrate 26 comprises any material known to grow CVD diamond and includes such materials as silicon carbide, sintered carbide, tungsten carbide, silicon, sapphire and similar materials. The substrate is usually in the form of a disk ranging in diameter from about two (2) to four (4) inches. However, other shapes have been used as the substrate for conditioning heads. The thickness of substrate 26 ranges from about 0.02 to about 0.25 inch, preferably 0.04 to 0.08 inch. After the uniform distribution of a mono-layer of diamond grit 28 onto the surface of substrate 26 at a density of about 0.1 to about 50 grains per $mm^2$, preferably about 1 to about 30 grains per $mm^2$, and the chemical vapor deposition of diamond outer layer 30 onto grit 28 and substrate 26, the overall thickness of conditioning disk 34 is increased by about 40 to about 150 microns. In the case of silicon substrates, the silicon is often bonded to backing plate 32 using well known adhesives to give conditioning disk 34 greater stability. Typically backing plate 32 comprises magnetic stainless steel having a thickness of about 0.04 to 0.08 inch.

Figure 4:
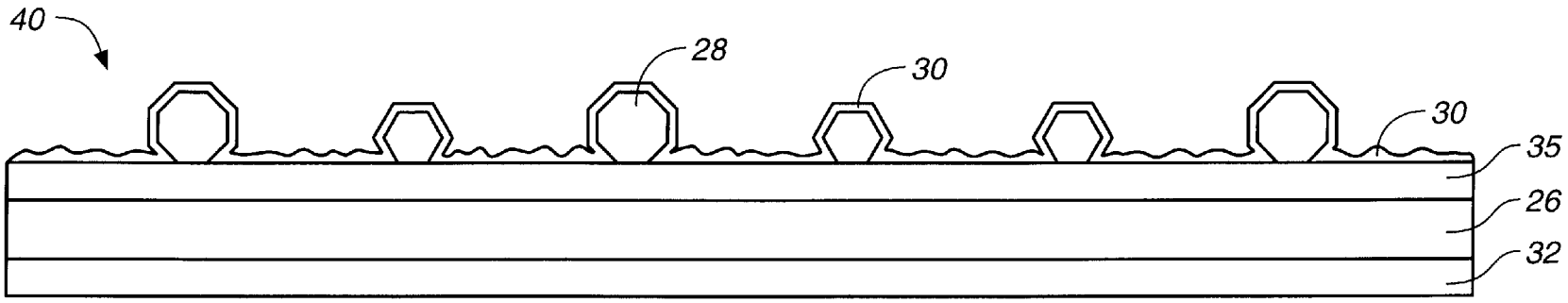
FIG. 4 illustrates a diagrammatic cross-sectional view of a polishing pad conditioning head in accordance with another embodiment of the present invention.

FIG. 4 shows a cross-section of conditioning disk 40 in accordance with another embodiment of the present invention in which interlayer 35 of CVD diamond is initially deposited on substrate 26 and then diamond grit 28 is uniformly distributed on the entire exposed surface of CVD diamond interlayer 35. The remaining steps set forth above in the preparation of conditioning disk 34 are repeated resulting in disk 40 in which diamond grit particles 28 can be placed closer together because of the improved bonding of the diamond particles to CVD diamond interlayer 35 before the outer coat 30 of CVD diamond is grown over grit 28. This embodiment is effective when diamond grit having a size greater than 100 microns is used.

Figure 5A:
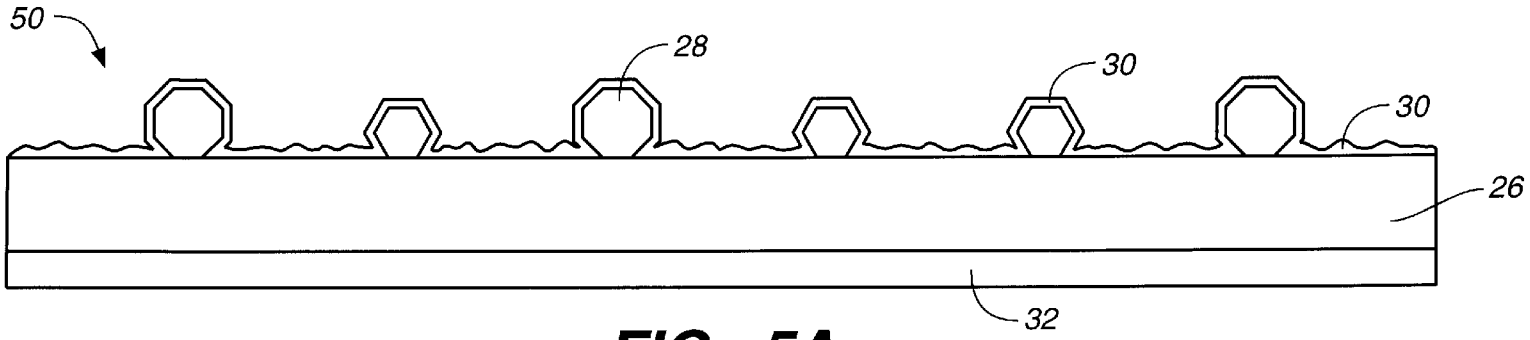
FIG. 5A illustrates a diagrammatic cross-sectional view of a polishing pad conditioning head in accordance with still another embodiment of the present invention.
Figure 5B:
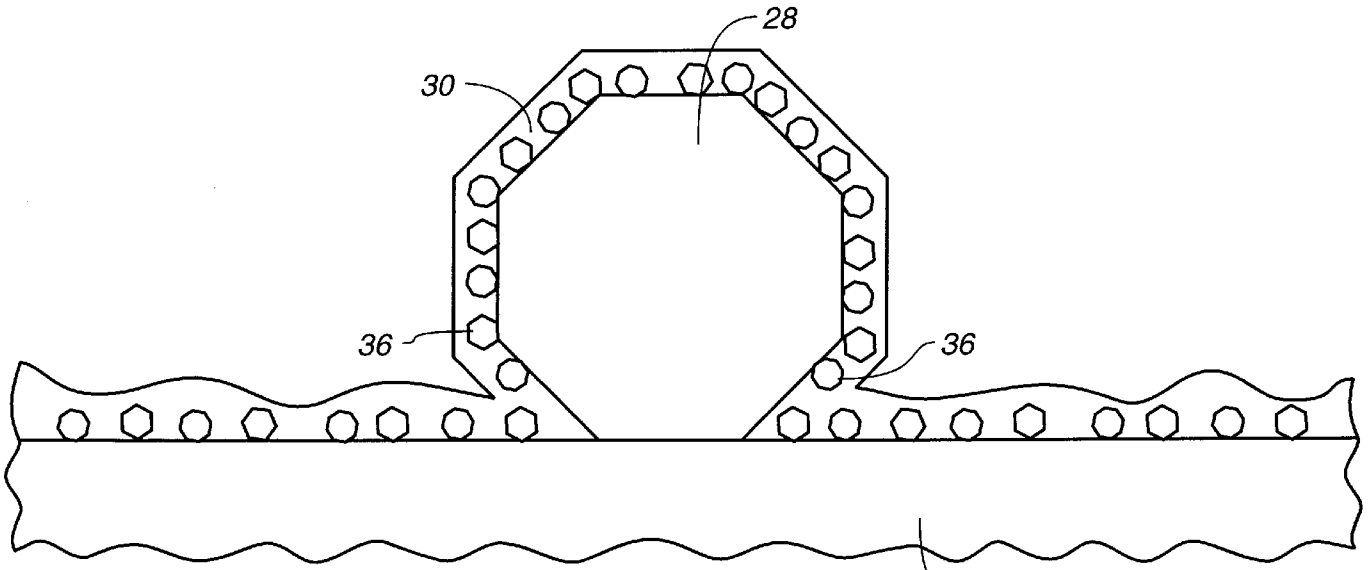
FIG. 5B illustrates a detailed cross-sectional view of the polishing pad conditioning head shown in FIG. 5A.

FIGS. 5A and 5B show a cross-section of conditioning disk 50 in accordance with still another embodiment of the present invention in which a mono-layer of large diamond grit 28, having a grain size of about 40 microns to about 150 microns, is first uniformly distributed over the entire exposed surface of substrate 26, and smaller grit 36 having a size of less than 1 micron is then uniformly distributed over the entire exposed surface of diamond grit 28 and substrate 26 at a density of greater than about 5000 grains per $mm^2$. CVD diamond is then grown over the diamond grit 36 and diamond grit 28 as shown in FIG. 5A so outer layer 30 is polycrystalline diamond instead of epitaxial diamond. It is believed that disk 50 of this embodiment has improved bonding between diamond grit 28 and the CVD diamond binder layer or outer layer 30.

Figure 6:
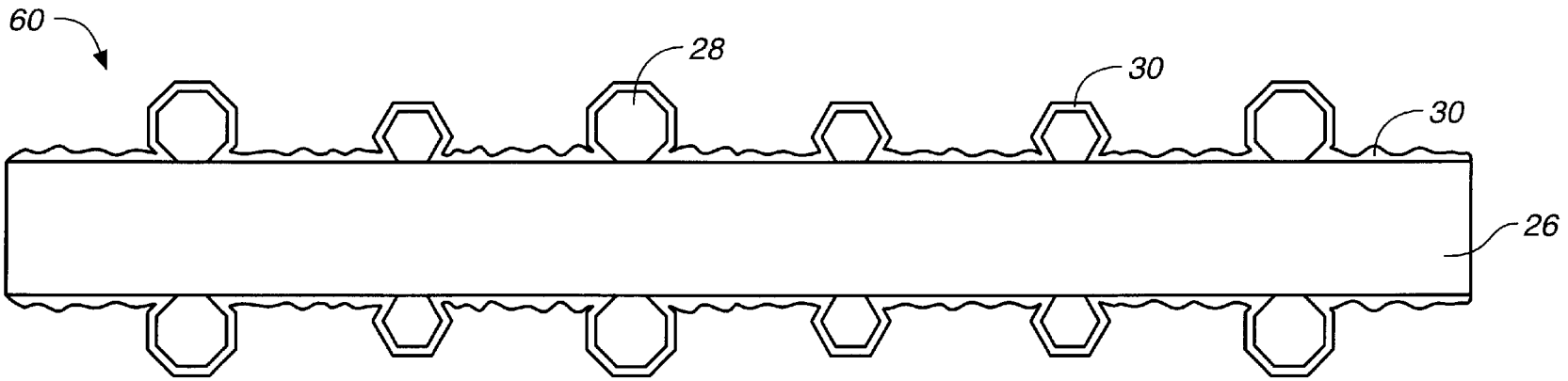
FIG. 6 illustrates a diagrammatic cross-sectional view a polishing pad conditioning head in accordance with another embodiment of the present invention.

FIG. 6 illustrates another embodiment of the present invention in which disk 60 comprises substrate 26 having first side 62 and second side 64 both covered with diamond grit 28 and encased with CVD diamond 30. In this embodiment, substrate 26 having diamond grit 28 on both sides 62 and 64 can be fixtured into a CVD reactor in such a manner well known in the art so that both sides are exposed to the feed gaseous mixture. Alternatively, substrate 26 is placed in the CVD reactor with diamond grit covered first side 62 exposed and the first side is encased with CVD diamond 30 in a first step. Sequentially, the first step is repeated with diamond grit covered second side 64 exposed and the second side is encased in a second step. Disk 50 can be used for conditioning polishing pads used in double sided polishers such as those for polishing silicon wafers and disks used in computer hard disk drives.

Figure 7A:
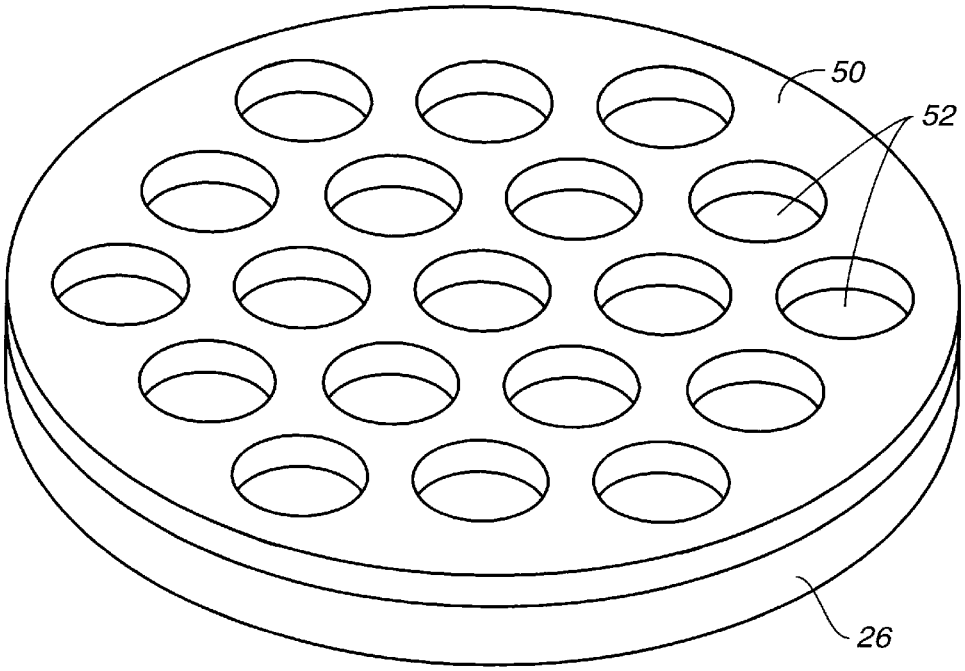
FIG. 7A illustrates the patterned shield of FIG. 7 on a wafer.
Figure 7:
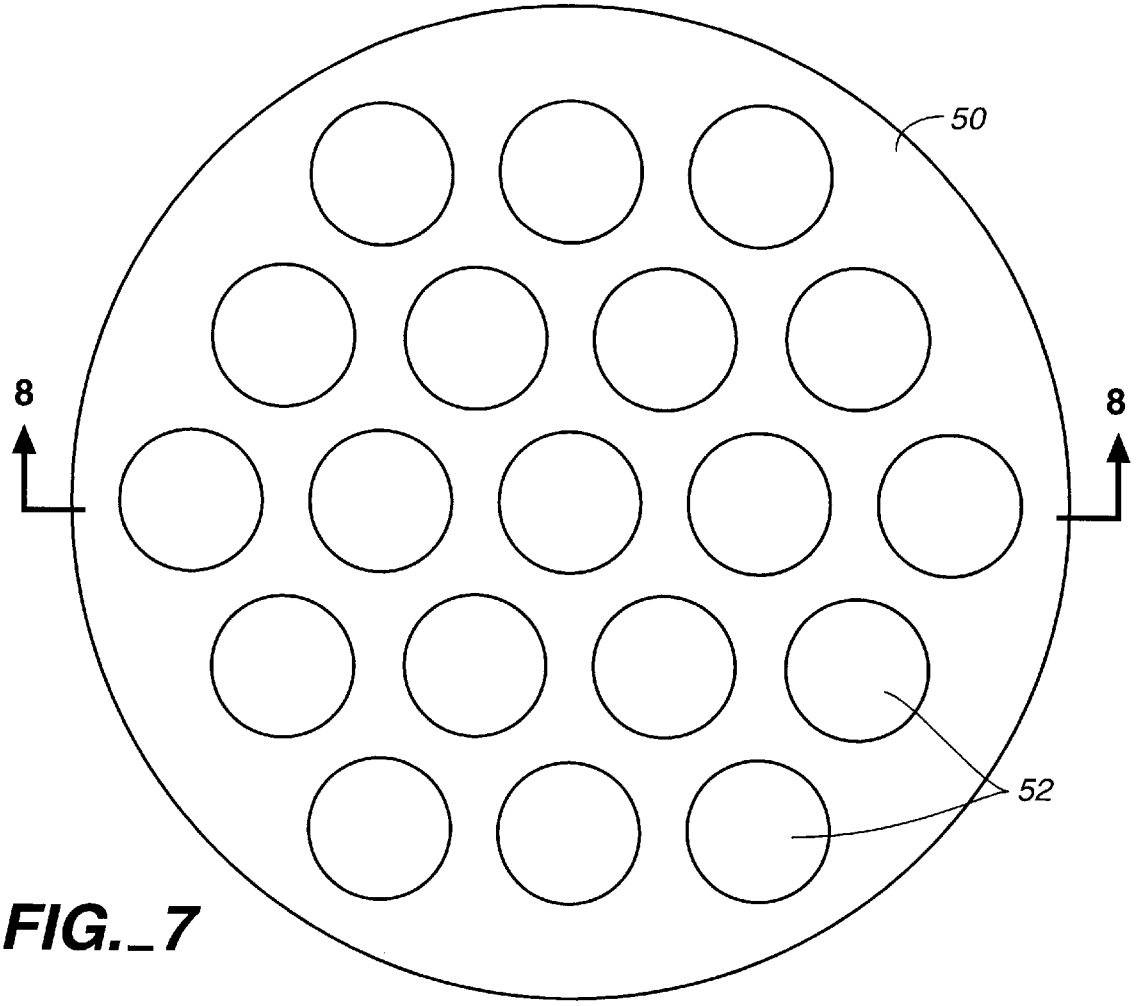
FIG. 7 illustrates a top view of a patterned shield used in another embodiment of the present invention.
Figure 8:
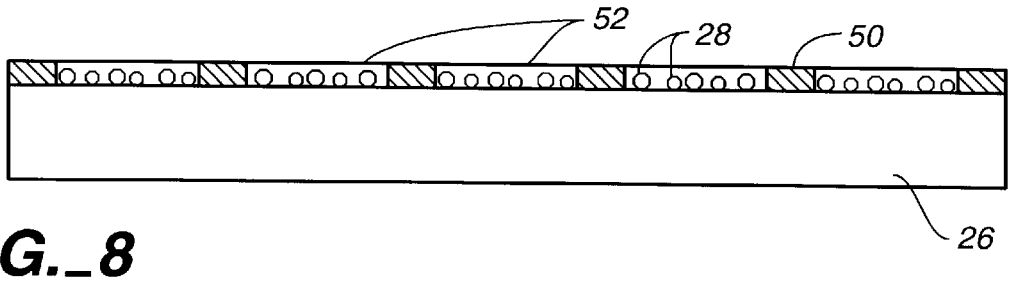
FIG. 8 illustrates a diagrammatic cross-sectional view of the patterned shield of FIG. 7A and a distribution of diamond grit on the wafer.

FIGS. 7, 7A and 8 show an embodiment of the present invention in which shield 50 having an evenly spaced pattern of shapes, e.g. dots 52, is used to obtain highly uniform distribution of concentrated areas of diamond grit 28 over the exposed surface of wafer 26. Dots 52 can also be in the form of squares, swirls, bars and other shapes. Shield 50 can be of any material, preferably a thermoplastic.

Figure 9A:
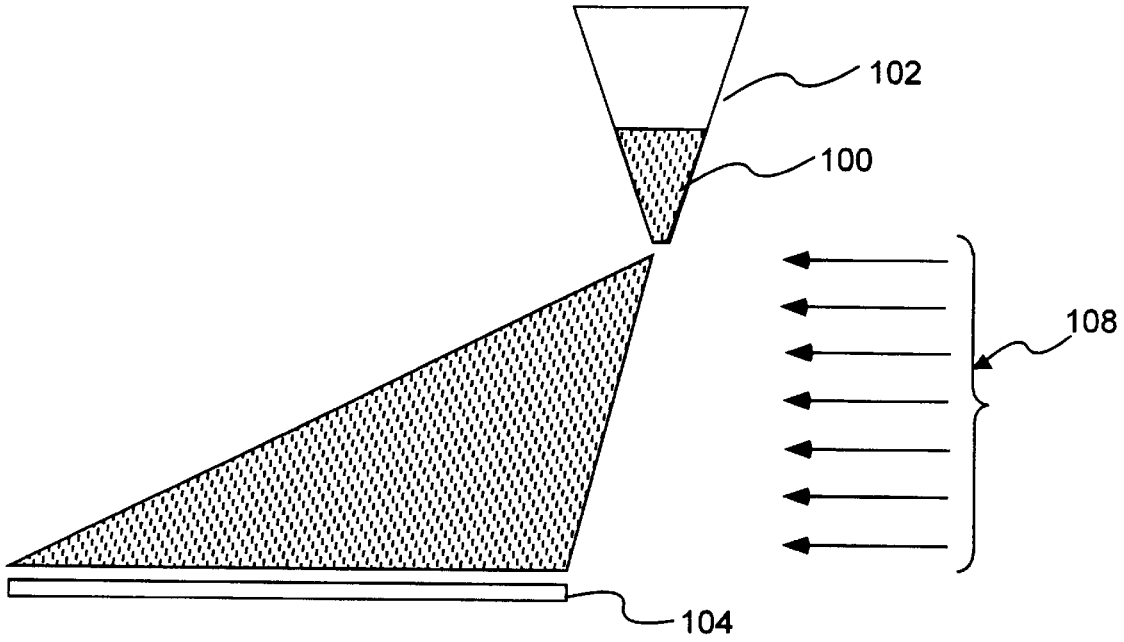
FIGS. 9A and B illustrate schematic side and top views, respectively, of an air dispersion technique for uniformly distributing diamond grit on a substrate.
Figure 9B:
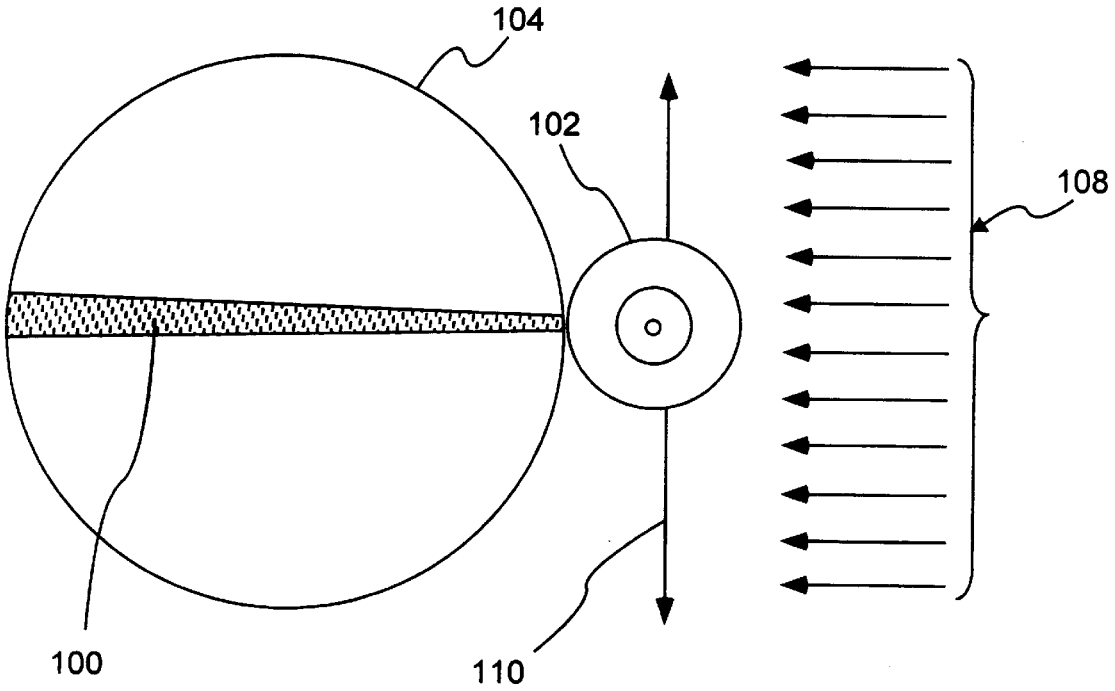

FIGS. 9A and B show an embodiment of the present invention in which grit 100 from container 102 is uniformly distributed by using an air dispersion technique in which grit 100 is dropped at a controlled rate from a fixed height above the wafer 104. A moving air current 108 is used to disperse the grit in a lateral direction across the substrate 104. Grit container 102 is moved in a direction orthogonal to the direction of the air current, as shown by line 110 of FIG. 9B, while grit 100 drops onto wafer 104 to provide a uniform distribution of grit 100 across the entire exposed surface of the substrate.

CONTROLS AND EXAMPLES

The controls and examples and discussion which follow further illustrate the superior performance of the conditioning heads of the present invention compared with those of the prior art. The controls and examples are for illustrative purposes and are not meant to limit the scope of the claims in any way.

Control 1

A prior art conditioning disk of the type shown in FIG. 2 and commercially available as a Sample-Marshall 100 grit disk, was mounted on a conditioning arm on Model 6DS-SP Strasbaugh Planizer and tested to determine the standard removal rate and polishing pad wear rate. The disk had a diameter of four inches and contained approximately 120,000 diamond particles having an average size of 100 microns nickel plated via a wet chemically process to a magnetic stainless steel plate. The results on this standard conditioning disk indicated that the polishing pad wear rate was such that up to 2000 wafers could be polished at a wafer removal rate of about 1800 Å per minute.

Control 2

A four (4) inch diameter tungsten carbide disk having a thickness of 0.25 inch was machined to form a grid of raised squares with trenches between each square. The machined disk was placed flat on a support fixture of an HFCVD reactor of the type generally described and claimed in the above-referenced Garg, et al., U.S. Pat. No. 5,186,973, as modified in accordance with the teachings of a Herlinger, et al., U.S. Ser. No. 08/575,763, filed Dec. 20, 1995, and assigned to $sp^3$, Inc., the assignee of the present invention, the relevant portions of which are incorporated herein by reference. The reactor was closed and 15.95 kw (145 volts and 110 amps) were supplied to heat the filament to about 2000° C. A mixture of 72 sccm (standard cubic centimeters per minute) of methane, about 2.5 vol T, in 3.0 slpm (standard liters per minute) of hydrogen was fed in the reactor for a period of 1 hour and 30 minutes at a pressure of 30 Torr to deposit about 1–2 microns of polycrystalline diamond onto the exposed surface of the machined disk containing the raised squares. The power was increased to 21.24 kw (177 volts and 120 amps) at a pressure of 25 Torr for an additional 21 hours and 30 minutes. The filament power was turned off and the coated wafer was cooled to room temperature under flowing hydrogen gas. A total of 10–15 microns of coherent polycrystalline diamond was deposited onto the wafer. The resulting conditioning disk had raised squares approximately 0.125 inch on each side with 0.125 inch trenches separating the raised squares. The disk was mounted on a conditioning arm on Model 6DS-SP Strasbaugh Planizer and tested to determine its effectiveness compared with the standard conditioning disk comprising nickel plated diamond grit on stainless steel set forth under Control 1. The results using this disk indicated that the material removal rate was approximately 63% of the typical removal rate using the standard conditioning disk. No noticeable difference was demonstrated in the wear on the polishing pad.

Control 3

A layer of photoresist can be deposited on a polycrystalline silicon substrate, exposed and developed to form a pyramidal pattern and a hard diamond film can then be grown on the patterned substrate using a procedure taught in Appel, et al., U.S. Pat. No. 5,536,202, to form a conditioning disk. Based on the results from preliminary experiments with similar patterned disks, it is believed that such a conditioning disk will not be able to achieve the removal rate of the standard conditioning disk.

EXAMPLE 1

A four (4) inch diameter silicon substrate having a thickness of 0.04 inch (~1 mm) was placed flat on a support fixture of an HFCVD reactor of the type described and claimed in the above-referenced Garg, et al., U.S. Pat. No. 5,186,973, as modified in accordance with the teachings of the above-referenced Herlinger, et al., U.S. Ser. No. 08/575,763. A mono-layer of synthetic diamond grit having an average particle diameter of about 50 microns was uniformly distributed over the entire exposed surface of the first side of the silicon substrate to achieve an average grit density of 20 grains or grit particles per $mm^2$ and a range from 15 to 30 grains per $mm^2$. The grit from a container was uniformly distributed by using an air dispersion technique in which the grit was dropped at a controlled rate from a fixed height, i.e. about three inches, above the wafer. A moving air current was used to disperse the grit in a lateral direction across the substrate. The grit container was moved in a direction orthogonal to the direction of the air current while the grit was dropping onto the wafer to provide a uniform distribution of grit across the entire exposed surface of the substrate. The substrate was rotated 90 degrees three times while this same air dispersion technique was repeated. Density of the grit is controlled by both the supply rate of the grit feed as well as the rate of translation of the substrate. Alternatively, the substrate can be moved in an orthogonal direction while the grit is being dropped onto the wafer to provide a uniform distribution of grit across the entire exposed surface of the substrate.

The substrate was then placed in the CVD diamond deposition reactor. The reactor was closed and 15.95 kw (145 volts and 110 amps) were supplied to heat the filament to about 2000° C. A mixture of 72 sccm (standard cubic centimeters per minute) of methane in 3.0 slpm (standard liters per minute) of hydrogen was fed into the reactor for a period of 1 hours and 30 minutes at a pressure of 30 Torr to deposit about 1–2 microns of polycrystalline diamond onto the exposed surface of the diamond grit and the silicon substrate. The power was increased to 21.24 kw (177 volts and 120 amps) at a pressure of 25 Torr for an additional 21 hours and 30 minutes. The filament power was turned off and the coated wafer was cooled to room temperature under flowing hydrogen gas. A total of 10–15 microns of coherent polycrystalline diamond was deposited onto the previously deposited CVD diamond layer. The second side of the disk from the latter step was bonded to a backing layer as illustrated in FIG. 3. The resulting conditioning head 34 was mounted on a conditioning arm on Model 6DS-SP Strasbaugh Planizer and tested to determine its effectiveness compared with the standard conditioning head comprising nickel plated diamond grit on stainless steel. The results unexpectedly indicated that the polishing pad wear rate was 42% of the wear rate obtained when using a standard conditioning disk. The disk of this Example 1 achieved a wafer material removal rate substantially equal to the standard conditioning disk.

EXAMPLE 2

The procedures of Example 1 were repeated except that the synthetic diamond grit was uniformly distributed onto the first side of the silicon substrate after the polycrystalline diamond had been grown on the silicon substrate and the coated wafer had cooled to room temperature. A mono-layer of synthetic diamond grit having an average particle size of about 100 microns was uniformly distributed over the entire exposed surface of the silicon substrate to achieve an average grit density of 2.5 grains or grit particles per $mm^2$ and a range from 0 to 6 grains per $mm^2$ using the air dispersion technique of Example 1 above. The reactor was closed and 15.95 kw (145 volts and 110 amps) were supplied to heat the filament to about 2000° C. A mixture of 65 sccm of methane mixed in 3.0 slpm of hydrogen was fed into the reactor for a period of 1 hour and 30 minutes at a pressure of 30 Torr to deposit about 1–2 microns of polycrystalline onto the exposed surface of the diamond grit and the silicon substrate. The power was increased to 21.24 kw (177 volts and 120 amps) at a pressure of 25 Torr for an additional 21 hours and 30 minutes. The filament power was turned off and the coated wafer was cooled to room temperature under flowing hydrogen gas. A total of 10–15 microns of coherent polycrystalline diamond was deposited onto the wafer. The second side of the disk from this step was bonded to a backing layer as illustrated in FIG. 4. The resulting conditioning head 40 was mounted on a conditioning arm on Model 6DS-SP Strasbaugh Planizer and tested to determine its effectiveness compared with the standard conditioning head comprising nickel plated diamond grit on stainless steel. It was observed that pad wear rate was one-half of the pad wear rate when using the standard conditioning disk. The conditioning head of this Example 2 maintained a wafer removal rate substantially equal to the standard conditioning disk. It was also observed that the uniformity of the wafer polishing results were superior to the standard process.

EXAMPLE 3

The procedures of Example 1 were repeated on the exposed surface of the first side of the substrate except that the second side of the resulting disk was not bonded to a backing layer as illustrated in FIG. 3. Instead, the procedures of Example 1 were repeated on the exposed surface of the second side of the disk to produce a dual sided conditioning disk as illustrated in FIG. 6. This substrate is configured to be the same diameter and same thickness as a silicon wafer or a hard disk drive media disk. In this case, the substrate was 100 mm in diameter and 0.025 inch thick. The finished conditioner is then loaded into a double-sided polisher in the same fashion as the regular product and both of the polishing pads are conditioned simultaneously.

EXAMPLE 4

The procedures of Example 1 was repeated on the exposed surface of the first side of the substrate except that the surface is protected in selected areas by a plastic shield having evenly spaced pattern squares (in place of dots 52 shown in FIGS. 7 and 7A). The shield prevents the grit from reaching certain areas on the surface of the wafer. It also allows a highly uniform pattern of concentrated squares of grit to form on the surface of the wafer. The procedure of this example has been shown to be effective in improving slurry transport between the polishing pad and the resulting conditioner disk of this embodiment of the present invention.

Without departing from the spirit and scope of this invention, one of ordinary skill in the art can make various changes and modifications to the invention to adapt it to various usages and conditions. As such, these changes and modifications are properly, equitably, and intended to be, within the full range of equivalents of the following claims.

What is claimed is:

1. In a polishing apparatus, a polishing pad conditioning head comprising a substrate, a mono-layer of diamond grit substantially uniformly distributed onto an exposed surface of said substrate, and an outer layer of chemical vapor deposited diamond grown onto the resulting grit covered substrate to encase and bond said diamond grit to said exposed surface, said diamond grit having an average grain size in the range of about 15 microns to about 150 microns and the individual grains of said diamond grit on the exposed surface of said substrate are separated by no less than ½ the average grain diameter.

2. The apparatus of claim 1 wherein average grain size of the diamond grit is in the range of about 35 microns to about 70 microns.

3. The apparatus of claim 2 wherein said grit is uniformly disbursed on the surface of said substrate at a density of about 1 to about 30 grains per $mm^2$.

4. The apparatus of claim 1 wherein said grit is uniformly distributed on the surface of said substrate at a density of about 0.1 to about 50 grains per $mm^2$.

5. The apparatus of claim 1 wherein a layer of smaller diamond grit having an average diameter less than 1 micron is uniformly distributed over said diamond grit and the exposed surface of the substrate after the dispersion of said diamond grit and prior to the chemical vapor deposition of said outer layer of diamond.

6. The apparatus of claim 1 wherein said conditioning head is bonded to a backing layer.

7. The apparatus of claim 1 wherein said diamond grit is distributed over the exposed surface of said substrate in a highly uniform manner.

8. The apparatus of claim 7 wherein an air dispersion step is used to uniformly distribute the diamond grit by dropping the grit at a controlled rate from a fixed height above said exposed surface into a moving air current to disperse the diamond grit in a lateral direction across said exposed surface while moving said source in a direction substantially orthogonal to the direction of the air current.

9. The apparatus of claim 8 wherein said substrate is rotated 90 degrees followed by said air dispersion step and repeating this procedure a plurality of times.

10. In a polishing apparatus, a polishing pad conditioning head comprising a substrate having a first side and a second side, a mono-layer of diamond grit substantially uniformly distributed over said first and second sides, and an outer layer of chemical vapor deposited diamond grown onto the resulting grit covered first and second sides to encase and bond said diamond grit to said sides, said diamond grit having an average grain size in the range of about 15 microns to about 150 microns and the individual grains of said diamond grit on the exposed surface of said substrate are separated by no less than ½ the average grain diameter.

11. A method of making a polishing pad conditioning head comprising the steps of:

(a) uniformly distributing a mono-layer of diamond grit having an average particle diameter in the range of about 15 to about 150 microns over an exposed surface of a substrate to achieve an average grit density in the range from about 0.1 to about 50 grains per $mm^2$, and the individual grains of said diamond grit on the surface of said substrate are separated by no less than ½ the average grain diameter;

(b) placing the resulting grit covered substrate into a hot filament chemical vapor deposition reactor;

(c) heating said grit covered substrate to a deposition temperature of about 600° to about 1100° C. by means of a filament electrically charged to a temperature in the range of about 1800° to 2800° C.;

(d) chemical vapor depositing an outer layer of coherent polycrystalline diamond onto the exposed surface of the grit covered substrate by passing a gaseous mixture of about 0.1% to about 10% hydrocarbon and the balance hydrogen into said reactor under a pressure of not greater than 100 Torr;

(e) recovering a polishing pad conditioning head having a grit covered substrate encased in polycrystalline diamond having a thickness of at least about 10% of the grit size.

12. The method of claim 11 wherein average grain size of the diamond grit is in the range of about 35 microns to about 70 microns.

13. The method of claim 12 wherein said grit is uniformly disbursed on the surface of said substrate at a density of about 1 to about 30 grains per $mm^2$.

14. The method of claim 11 wherein a layer of diamond grit having an average diameter less than 1 micron is uniformly distributed over the exposed surface of the substrate after the dispersion of said diamond grit and prior to the chemical vapor deposition of said outer layer of diamond.

15. The apparatus of claim 14 wherein said conditioning head is bonded to a backing layer.

16. The method of claim 14 wherein the resulting disk is bonded to a backing layer.

17. The method of claim 11 wherein an air dispersion step is used to uniformly distribute the diamond grit by dropping the grit at a controlled rate from a fixed height above said exposed surface into a moving air current to disperse the diamond grit in a lateral direction across said exposed surface while moving said source in a direction substantially orthogonal to the direction of the air current.

18. The method of claim 17 wherein said substrate is rotated 90 degrees followed by said air dispersion step and repeating this procedure a plurality of times.

19. The method of claim 11 wherein said exposed surface is initially protected in selected areas by a patterned shield to prevent said diamond grit from reaching the protected areas and to allow said diamond grit to be distributed over the exposed surface of said substrate in a highly uniform manner.

20. A method of making a polishing pad conditioning head comprising the steps of:

(a) placing a substrate into a hot filament chemical vapor deposition reactor;

(b) heating substrate to a deposition temperature of about 600° to about 1100° C. by means of a filament electrically charged to a temperature in the range of about 1800° to 2800° C.;

(c) chemical vapor depositing an layer of coherent polycrystalline diamond onto an exposed surface of said substrate by passing a gaseous mixture of about 0.1% to about 10% hydrocarbon and the balance hydrogen into said reactor under a pressure of not greater than 100 Torr;

(d) uniformly distributing a mono-layer of diamond grit having an average particle diameter in the range of about 15 to about 150 microns over an exposed surface of said layer of polycrystalline diamond to achieve an average grit density in the range from about 0.1 to about 50 grains per $mm^2$ and the individual grains of said diamond grit on the surface of said substrate are separated by no less than ½ the average grain diameter;

(e) placing the resulting grit covered substrate into a hot filament chemical vapor deposition reactor;

(f) heating said grit covered substrate to a deposition temperature of about 600° to about 1100° C. by means of a filament electrically charged to a temperature in the range of about 1800° to 2800° C.;

(g) chemical vapor depositing an outer layer of coherent polycrystalline diamond onto the exposed surface of the grit covered substrate by passing a gaseous mixture of about 0.1% to about 10% hydrocarbon and the balance hydrogen into said reactor under a pressure of not greater than 100 Torr; and (h) recovering a polishing pad conditioning head having a grit covered substrate encased in polycrystalline diamond having a thickness of at least about 10% of the grit size.

21. The method of claim 20 wherein average grain size of the diamond grit is in the range of about 35 microns to about 70 microns.

22. The method of claim 21 wherein said grit is uniformly disbursed on the surface of said substrate at a density of about 1 to about 30 grains per $mm^2$.

23. The method of claim 20 wherein a layer of diamond grit having an average diameter less than 1 micron is uniformly distributed over the exposed surface of the substrate after the dispersion of said diamond grit and prior to the chemical vapor deposition of said outer layer of diamond.

24. The method of claim 20 wherein said exposed surface is initially protected in selected areas by a patterned shield to prevent said diamond grit from reaching the protected areas and to allow said diamond grit to be distributed over the exposed surface of said substrate in a highly uniform manner.

25. The method of claim 24 wherein an air dispersion step is used to uniformly distribute the diamond grit by dropping the grit at a controlled rate from a fixed height above said exposed surface into a moving air current to disperse the diamond grit in a lateral direction across said exposed surface while moving said source in a direction substantially orthogonal to the direction of the air current.

26. The method of claim 25 wherein said substrate is rotated 90 degrees followed by said air dispersion step and repeating this procedure a plurality of times.

27. A method of making a polishing pad conditioning head comprising the steps of:

(a) uniformly distributing a mono-layer of diamond grit having an average particle diameter in the range of about 15 to about 150 microns over an exposed surface of a first side of a substrate to achieve an average grit density in the range from about 0.1 to about 50 grains per $mm^2$, and the individual grains of said diamond grit on the surface of said substrate are separated by no less than ½ the average grain diameter;

(b) placing the resulting substrate into a hot filament chemical vapor deposition reactor;

(c) heating said resulting substrate to a deposition temperature of about 600° to about 1100° C. by means of a filament electrically charged to a temperature in the range of about 1800° to 2800° C.;

(d) chemical vapor depositing an outer layer of coherent polycrystalline diamond onto the exposed surface of the grit covered side by passing a gaseous mixture of about 0.1% to about 10% hydrocarbon and the balance hydrogen into said reactor under a pressure of not greater than 100 Torr;

(e) cooling said substrate;

(f) uniformly distributing a mono-layer of diamond grit having an average particle diameter in the range of about 15 to about 150 microns over an exposed surface of a second side of said substrate to achieve an average grit density in the range from about 0.1 to about 50 grains per $mm^2$, and the individual grains of said diamond grit on the surface of said substrate are separated by no less than ½ the average grain diameter;;

(g) repeating steps (b) through (e); and (h) recovering a polishing pad conditioning head having both sides of said substrate covered with grit and encased in polycrystalline diamond having a thickness of at least about 10% of the grit size for each side.

28. The method of claim 27 wherein average grain size of the diamond grit is in the range of about 35 microns to about 70 microns.

29. The method of claim 27 wherein said grit is uniformly distributed on the surface of said substrate at a density of about 0.1 to about 50 grains per $mm^2$.

30. In a polishing apparatus, a polishing pad conditioning head comprising a substrate, a mono-layer of diamond grit having an average grain size in the range of about 15 microns to about 150 microns substantially uniformly distributed onto an exposed surface of said substrate, a layer of a smaller diamond grit having an average diameter less than 1 micron uniformly distributed over the larger diamond grit, and the exposed surface of the substrate and an outer layer of chemical vapor deposited diamond grown onto the resulting grit covered substrate to encase and bond said diamond grit to said exposed surface.

31. A method of making a polishing pad conditioning head comprising the steps of:

(a) uniformly distributing a mono-layer of diamond grit having an average particle diameter in the range of about 15 to about 150 microns over an exposed surface of a substrate to achieve an average grit density in the range from about 0.1 to about 50 grains per $mm^2$;

(b) uniformly distributing a layer of a smaller diamond grit having an average diameter less than 1 micron uniformly over the larger diamond grit;

(c) placing the resulting grit covered substrate into a hot filament chemical vapor deposition reactor;

(d) heating said grit covered substrate to a deposition temperature of about 600° to about 1100° C. by means of a filament electrically charged to a temperature in the range of about 1800° to 2800° C.;

(e) chemical vapor depositing an outer layer of coherent polycrystalline diamond onto the exposed surface of the grit covered substrate by passing a gaseous mixture of about 0.1% to about 10% hydrocarbon and the balance hydrogen into said reactor under a pressure of not greater than 100 Torr;

(f) recovering a polishing pad conditioning head having a grit covered substrate encased in polycrystalline diamond having a thickness of at least about 10% of the grit size.

32. A method of making a polishing pad conditioning head comprising the steps of:

(a) initially protecting said exposed surface of said substrate in selected areas by a patterned shield to prevent a diamond grit from reaching the protected areas and to allow said diamond grit to be distributed over the exposed surface of said substrate in a highly uniform manner;

(b) uniformly distributing a mono-layer of diamond grit having an average particle diameter in the range of about 15 to about 150 microns over an exposed surface of a substrate to achieve an average grit density in the range from about 0.1 to about 50 grains per $mm^2$;

(c) placing the resulting grit covered substrate into a hot filament chemical vapor deposition reactor;

(d) heating said grit covered substrate to a deposition temperature of about 600° to about 1100° C. by means of a filament electrically charged to a temperature in the range of about 1800° to 2800° C.;

(e) chemical vapor depositing an outer layer of coherent polycrystalline diamond onto the exposed surface of the grit covered substrate by passing a gaseous mixture of about 0.1% to about 10% hydrocarbon and the balance hydrogen into said reactor under a pressure of not greater than 100 Torr; and (f) recovering a polishing pad conditioning head having a grit covered substrate encased in polycrystalline diamond having a thickness of at least about 10% of the grit size.

33. A method of making a polishing pad conditioning head comprising the steps of:

(a) placing a substrate into a hot filament chemical vapor deposition reactor;

(b) heating substrate to a deposition temperature of about 600° to about 1100° C. by means of a filament electrically charged to a temperature in the range of about 1800° to 2800° C.;

(c) chemical vapor depositing an layer of coherent polycrystalline diamond onto the exposed surface of said substrate by passing a gaseous mixture of about 0.1% to about 10% hydrocarbon and the balance hydrogen into said reactor under a pressure of not greater than 100 Torr;

(d) uniformly distributing a mono-layer of diamond grit having an average particle diameter in the range of about 15 to about 150 microns over an exposed surface of said layer of polycrystalline diamond to achieve an average grit density in the range from about 0.1 to about 50 grains per mm;

(e) uniformly distributing a layer of a smaller diamond grit having an average diameter less than 1 micron uniformly over the larger diamond grit;

(f) placing the resulting grit covered substrate into a hot filament chemical vapor deposition reactor;

(g) heating said grit covered substrate to a deposition temperature of about 600° to about 1100° C. by means of a filament electrically charged to a temperature in the range of about 1800° to 2800° C.;

(h) chemical vapor depositing an outer layer of coherent polycrystalline diamond onto the exposed surface of the grit covered substrate by passing a gaseous mixture of about 0.1% to about 10% hydrocarbon and the balance hydrogen into said reactor under a pressure of not greater than 100 Torr; and (i) recovering a polishing pad conditioning head having a grit covered substrate encased in polycrystalline.

34. A method of making a polishing pad conditioning head comprising the steps of:

(a) placing a substrate into a hot filament chemical vapor deposition reactor;

(b) heating substrate to a deposition temperature of about 600° to about 1100° C. by means of a filament electrically charged to a temperature in the range of about 1800° to 2800° C.;

(c) chemical vapor depositing a layer of coherent polycrystalline diamond onto the exposed surface of said substrate by passing a gaseous mixture of about 0.1% to about 10% hydrocarbon and the balance hydrogen into said reactor under a pressure of not greater than 100 Torr;

(d) initially protecting said exposed surface of said substrate in selected areas by a patterned shield to prevent a diamond grit from reaching the protected areas and to allow said diamond grit to be distributed over the exposed surface of said substrate in a highly uniform manner;

(e) uniformly distributing a mono-layer of diamond grit having an average particle diameter in the range of about 15 to about 150 microns over an exposed surface of said layer of polycrystalline diamond to achieve an average grit density in the range from about 0.1 to about 50 grains per $mm^2$;

(f) placing the resulting grit covered substrate into a hot filament chemical vapor deposition reactor;

(g) heating said grit covered substrate to a deposition temperature of about 600° to about 1100° C. by means of a filament electrically charged to a temperature in the range of about 1800° to 2800° C.;

(h) chemical vapor depositing an outer layer of coherent polycrystalline diamond onto the exposed surface of the grit covered substrate by passing a gaseous mixture of about 0.1% to about 10% hydrocarbon and the balance hydrogen into said reactor under a pressure of not greater than 100 Torr; and (i) recovering a polishing pad conditioning head having a grit covered substrate encased in polycrystalline.

35. In a polishing apparatus, a polishing pad conditioning head comprising a substrate having a first side and a second side, a mono-layer of diamond grit having an average grain size in the range of about 15 microns to about 150 microns substantially uniformly distributed over said first and second sides, a layer of a smaller diamond grit having an average diameter less than 1 micron uniformly distributed over the larger diamond grit on the first and second sides, and an outer layer of chemical vapor deposited diamond grown onto the resulting grit covered first and second sides to encase and bond said diamond grit to said first and second sides.

* * * * *